US012440000B2

(12) United States Patent
Suzuki et al.

(10) Patent No.: US 12,440,000 B2
(45) Date of Patent: Oct. 14, 2025

(54) UPPER AND SHOE INCLUDING THE SAME

(71) Applicant: ASICS CORPORATION, Hyogo (JP)

(72) Inventors: Chihaya Suzuki, Hyogo (JP); Seiji Yano, Hyogo (JP); Hiroki Nakamura, Hyogo (JP); Satoru Abe, Hyogo (JP); Sho Takamasu, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 2 days.

(21) Appl. No.: 18/272,976

(22) PCT Filed: Jan. 21, 2021

(86) PCT No.: PCT/JP2021/001978
§ 371 (c)(1),
(2) Date: Jul. 18, 2023

(87) PCT Pub. No.: WO2022/157875
PCT Pub. Date: Jul. 28, 2022

(65) Prior Publication Data
US 2024/0081481 A1 Mar. 14, 2024

(51) Int. Cl.
*A43B 23/02* (2006.01)

(52) U.S. Cl.
CPC ..... *A43B 23/0245* (2013.01)

(58) Field of Classification Search
CPC ..... A43B 23/0235; A43B 23/024; A43B 23/0245; A43B 23/0265; A43B 23/027; A43B 23/0275
See application file for complete search history.

(56) References Cited

U.S. PATENT DOCUMENTS 4,133,191 A * 1/1979 Blore ..... D04B 1/104 28/163
4,232,458 A * 11/1980 Bartels ..... A43B 1/05 139/413
4,891,958 A * 1/1990 Cournoyer ..... D04B 1/104 66/196

(Continued)

FOREIGN PATENT DOCUMENTS

EP 1163860 A1 12/2001
JP 2009-538179 A 11/2009

(Continued)

OTHER PUBLICATIONS

International Search Report issued in corresponding International Patent Application No. PCT/JP2021/001978, filed Apr. 13, 2021, with English translation.

(Continued)

*Primary Examiner* — Megan E Lynch
(74) *Attorney, Agent, or Firm* — Rimon P.C.

(57) ABSTRACT

An upper includes an upper body covering the instep of a foot. An upper body includes a first layer, a second layer disposed with a gap from the first layer, and a third layer connecting the first layer and the second layer. A part of the upper body is disposed with a low stiffness region having lower stiffness than an adjacent region. At least a part of the low stiffness region has a point in which the third layer is not disposed. A plurality of holes is disposed in at least a part of a portion of the first layer and the second layer of the low stiffness region corresponding to the point in which the third layer is not disposed.

12 Claims, 11 Drawing Sheets

(56) References Cited

U.S. PATENT DOCUMENTS 5,896,758 A * 4/1999 Rock ..... D04B 21/18 66/194
6,156,406 A * 12/2000 Rock ..... B32B 5/26 428/86
6,401,364 B1 * 6/2002 Burt ..... A43B 1/00 36/3 R
6,482,492 B1 * 11/2002 Hung ..... A43B 23/0205 36/3 R
7,574,818 B2 8/2009 Meschter
10,212,989 B2 2/2019 Inomata et al.
10,863,794 B2 * 12/2020 Bruce ..... A43B 23/0235
12,082,639 B2 * 9/2024 Lang ..... D04B 1/22
2005/0016023 A1 * 1/2005 Burris ..... B29D 35/146 36/55
2005/0076536 A1 4/2005 Hatfield et al.
2005/0193592 A1 * 9/2005 Dua ..... A43B 23/0265 36/45
2007/0199210 A1 * 8/2007 Vattes ..... A43B 7/085 36/45
2008/0250668 A1 * 10/2008 Marvin ..... A43B 23/0255 36/50.1
2011/0088285 A1 * 4/2011 Dojan ..... A43B 23/0225 36/87
2011/0302810 A1 * 12/2011 Borel ..... A43B 23/027 36/114
2012/0234052 A1 * 9/2012 Huffa ..... D04B 1/123 66/126 R
2012/0279260 A1 * 11/2012 Dua ..... D04B 1/16 66/171
2013/0269209 A1 * 10/2013 Lang ..... A43B 1/028 12/146 C
2013/0303041 A1 * 11/2013 Kim ..... B32B 25/16 442/373
2013/0312284 A1 * 11/2013 Berend ..... A43B 1/0072 36/83
2014/0157623 A1 * 6/2014 Dekovic ..... A43B 23/0245 36/47
2015/0216256 A1 * 8/2015 Podhajny ..... A43B 1/04 12/142 R
2016/0106182 A1 4/2016 Yun
2016/0174661 A1 * 6/2016 Nonogawa ..... A43B 23/0245 36/88
2016/0309843 A1 * 10/2016 Song ..... A43B 7/06
2016/0345675 A1 * 12/2016 Bruce ..... D04C 3/48
2017/0238648 A1 8/2017 Farris
2018/0035756 A1 * 2/2018 Lin ..... A43B 23/026
2018/0177260 A1 * 6/2018 Bell ..... A43B 23/0205
2019/0328075 A1 * 10/2019 Poulsen ..... A43B 23/0235
2020/0029647 A1 * 1/2020 Unnewehr ..... D04B 1/24
2020/0391476 A1 * 12/2020 Rezab ..... B32B 5/26
2022/0000219 A1 * 1/2022 Bessho ..... A43B 1/028
2022/0304421 A1 * 9/2022 Thompson ..... A43B 23/0245

FOREIGN PATENT DOCUMENTS

JP 2017-537715 A 12/2017
WO 2016/093961 A1 6/2016
WO 2017/061002 A1 4/2017

OTHER PUBLICATIONS

Extended European Search Report issued for the corresponding European patent Application No. 21920988.9 on Jan. 23, 2024.

* cited by examiner

UPPER AND SHOE INCLUDING THE SAME

CROSS-REFERENCE OF RELATED APPLICATIONS

This application is the U.S. National Phase under 35 U.S.C. § 371 of International Patent Application No. PCT/JP2021/001978, filed on Jan. 21, 2021, the entire disclosure of which Application is incorporated by reference herein.

FIELD

The present invention relates to an upper and a shoe including the same.

BACKGROUND

Conventionally, shoes including uppers are known. For example, Patent Literature 1 discloses an upper including a first layer, a second layer disposed with a space from the first layer, and a third layer disposed between the first layer and the second layer. The upper disclosed in Patent Literature 1 has a point in which the third layer is disposed and a point in which the third layer is not disposed.

CITATION LIST

Patent Literature

Patent Literature 1: JP 2017-537715 A

SUMMARY

Technical Problem

In the upper disclosed in Patent Literature 1, the stiffness of the point in which the third layer is not disposed is lower than the stiffness of the point in which the third layer is disposed. However, there is a desire to further reduce the stiffness of an upper locally in order to improve the followability of the upper with respect to bending and twisting of a foot during movement.

The present invention has been made in view of the above, and a purpose of the present invention is to obtain an upper capable of locally reducing the stiffness of the upper as compared with a conventional upper.

Solution to Problem

In order to solve the above problem and achieve the object, an upper includes an upper body covering the instep of a foot. An upper body includes a first layer, a second layer disposed with a gap from the first layer, and a third layer connecting the first layer and the second layer. A part of the upper body is disposed with a low stiffness region having lower stiffness than an adjacent region. At least a part of the low stiffness region has a point in which the third layer is not disposed. A plurality of holes is disposed in at least a part of a portion of the first layer and the second layer of the low stiffness region corresponding to the point in which the third layer is not disposed.

Advantageous Effects of Invention

An upper according to the present invention has an effect of locally reducing the stiffness of the upper as compared with a conventional upper.

DESCRIPTION OF EMBODIMENTS

Figure 1:
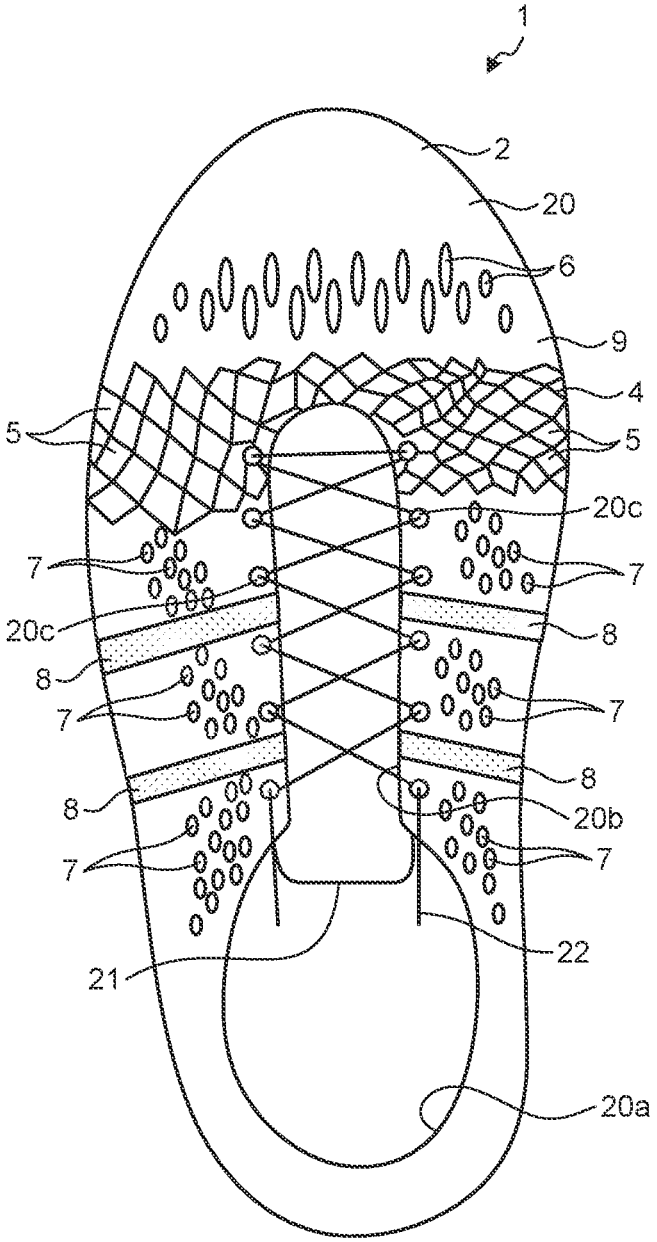
FIG. 1 is a plan view of a shoe according to a first embodiment of the present invention.

Hereinafter, embodiments of an upper according to the present invention and a shoe including the same will be described in detail with reference to the drawings. Note that the present invention is not limited by the embodiments.

In the following embodiments, a direction in which a shoe center axis, which is a perpendicular line passing through a shoe center in a plan view of a shoe, extends is referred to as a front-rear direction, and a direction orthogonal to the front-rear direction in a plan view of the shoe is referred to as a foot width direction.

In addition, of the front-rear direction, a direction directed from the end on the side where a portion of an upper covering the rearfoot of a foot is positioned toward the end on the side where a portion covering the forefoot of the foot is positioned is referred to as a front side, and of the front-rear direction, a direction directed from the end on the side where a portion of the upper covering the forefoot of the foot is positioned toward the end on the side where a portion of the upper covering the rearfoot of the foot is positioned is referred to as a rear side.

In addition, a median side of a foot in the anatomical position is referred to as a medial foot side, and the side opposite to the median side of the foot in the anatomical position is referred to as a lateral foot side. That is, the side closer to the median line in the anatomical position is referred to as the medial foot side, and the side farther from the median line in the anatomical position is referred to as the lateral foot side.

In addition, when a line along the foot width direction passing through a position corresponding to 25% to 50% of the dimension in the front-rear direction of the upper from the front end of the upper is defined as a first boundary line, and a line along the foot width direction passing through a position corresponding to 55% to 80% of the dimension in the front-rear direction of the upper from the front end of the upper is defined as a second boundary line, a portion positioned in front of the first boundary line is referred to as an upper forefoot portion, a portion sandwiched between the first boundary line and the second boundary line is referred to as an upper midfoot portion, and a portion positioned behind the second boundary line is referred to as an upper rearfoot portion.

The upper forefoot portion corresponds to a portion covering the forefoot of a foot of a wearer with a standard body shape, the upper midfoot portion corresponds to a portion covering the midfoot of a foot of a wearer with a standard body shape, and the upper rearfoot portion corresponds to a portion covering the rearfoot of a foot of a wearer with a standard body shape. In other words, the first boundary line is a line roughly along the MP joint of a wearer with a standard body shape, and the second boundary line is a line roughly along the Chopart joint of a wearer with a standard body shape.

Furthermore, a height direction means a direction orthogonal to both the front-rear direction and the foot width direction unless otherwise specified, and a thickness means a dimension in the height direction unless otherwise specified.

First Embodiment

Figure 2:
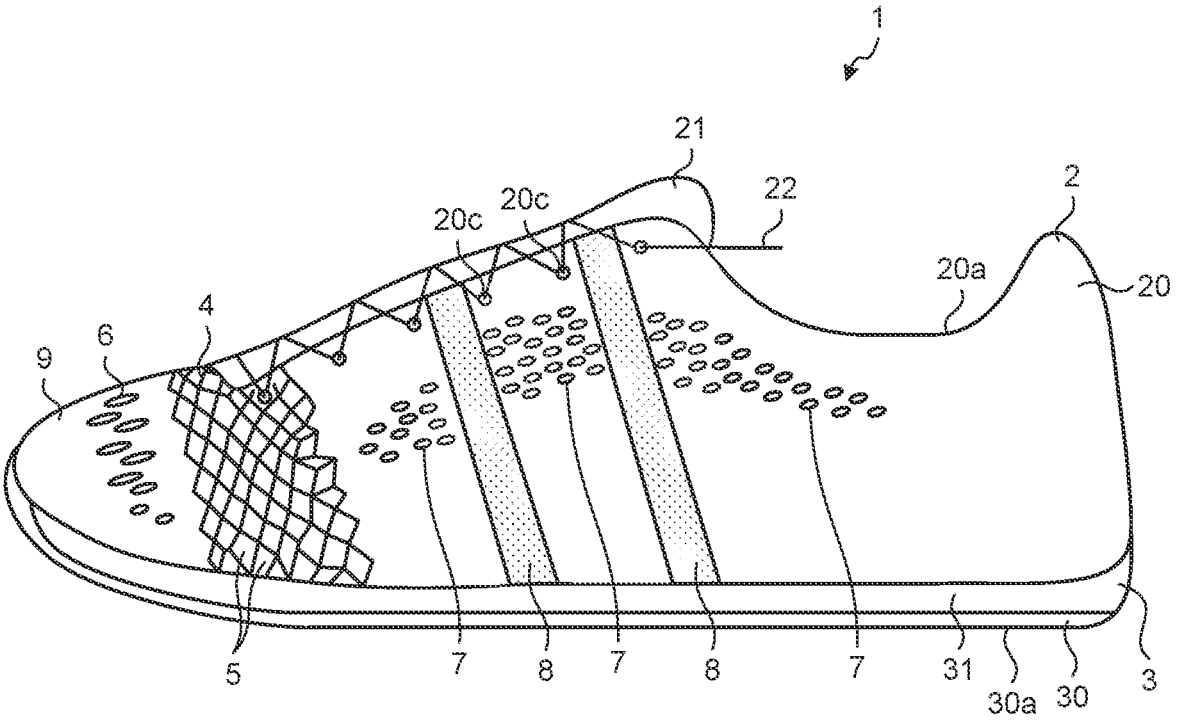
FIG. 2 is a side view of the shoe on a lateral foot side according to the first embodiment.

FIG. 1 is a plan view of a shoe 1 according to a first embodiment of the present invention. FIG. 2 is a side view of the shoe 1 on a lateral foot side according to the first embodiment. In FIGS. 1 and 2, only the shoe 1 for a left foot is illustrated. Since the shoe 1 has a right-left symmetrical structure for a left foot and a right foot, only the shoe 1 for a left foot is described in the present embodiment, and the description of the shoe 1 for a right foot is omitted. The shoe 1 is, for example, a shoe for running or walking, a shoe for climbing, or a shoe for sports such as tennis and basketball. As illustrated in FIG. 2, the shoe 1 includes an upper 2 and a sole 3 positioned below the upper 2.

As illustrated in FIG. 1, the upper 2 includes an upper body 20, a shoe tongue 21, and a shoelace 22.

The upper body 20 covers a part on the instep side of a foot. At the upper portion of the upper body 20, a foot insertion opening 20*a* for inserting a foot of a wearer and an opening 20*b* communicating with the foot insertion opening 20*a* and extending from the foot insertion opening 20*a* to the front side are disposed. On both side edges of the opening 20*b* in the foot width direction, a plurality of string passing portions 20*c* spaced apart from each other in the front-rear direction is disposed. The structure of the string passing portions 20*c* is not particularly limited as long as a shoelace 22 can be passed therethrough, but in the present embodiment, the string passing portions 20*c* are through holes that pass through the upper body 20 in the vertical direction. A part of the upper body 20 is disposed with a low stiffness region 4. Details of the low stiffness region 4 are described later.

The shoe tongue 21 is a member for protecting the instep of a wearer. The shoe tongue 21 covers the opening 20*b* inside the upper body 20. The shoe tongue 21 is fixed to the upper body 20 by stitching, welding, bonding, or a combination thereof. As the material of the upper body 20 and the shoe tongue 21, woven fabric, knitted fabric, synthetic leather, or resin is used for example. In particular, in the shoe 1 required to have air permeability and lightweight property, a double raschel warp knitted fabric knitted with polyester yarn is preferably used as the material of the upper body 20 and the shoe tongue 21. Note that the material of the upper body 20 and the shoe tongue 21 is not limited to those exemplified.

The shoelace 22 is a string-like member that is alternately passed through the string passing portions 20*c* disposed at both side edges of the opening 20*b* in the foot width direction, and is detachably attached to the upper body 20.

As illustrated in FIG. 2, the sole 3 covers the sole of a foot. The sole 3 includes an outsole 30 and a midsole 31. The sole 3 is fixed to the upper body 20 by stitching, welding, bonding, or a combination thereof. The lower surface of the outsole 30 serves as a ground contact surface 30*a* to be contacted on the ground. The midsole 31 is positioned on the upper surface of the outsole 30 and has a cushioning property. Note that the outsole 30 may be integrated with the midsole 31. The midsole 31 integrated with the outsole 30 is also referred to as a "unisole".

The sole 3 includes an inner sole (not illustrated) that covers the lower opening of the upper body 20. The inner sole is fixed to the upper surface of the midsole 31 by bonding or welding. In addition, the inner sole is fixed to the lower edge of the above upper body 20 by stitching. The sole 3 may have a structure in which the inner sole is omitted. The shoe 1 may include an insole. If the shoe 1 includes an insole, the insole is installed on the sole 3 inside the upper 2.

Figure 3:
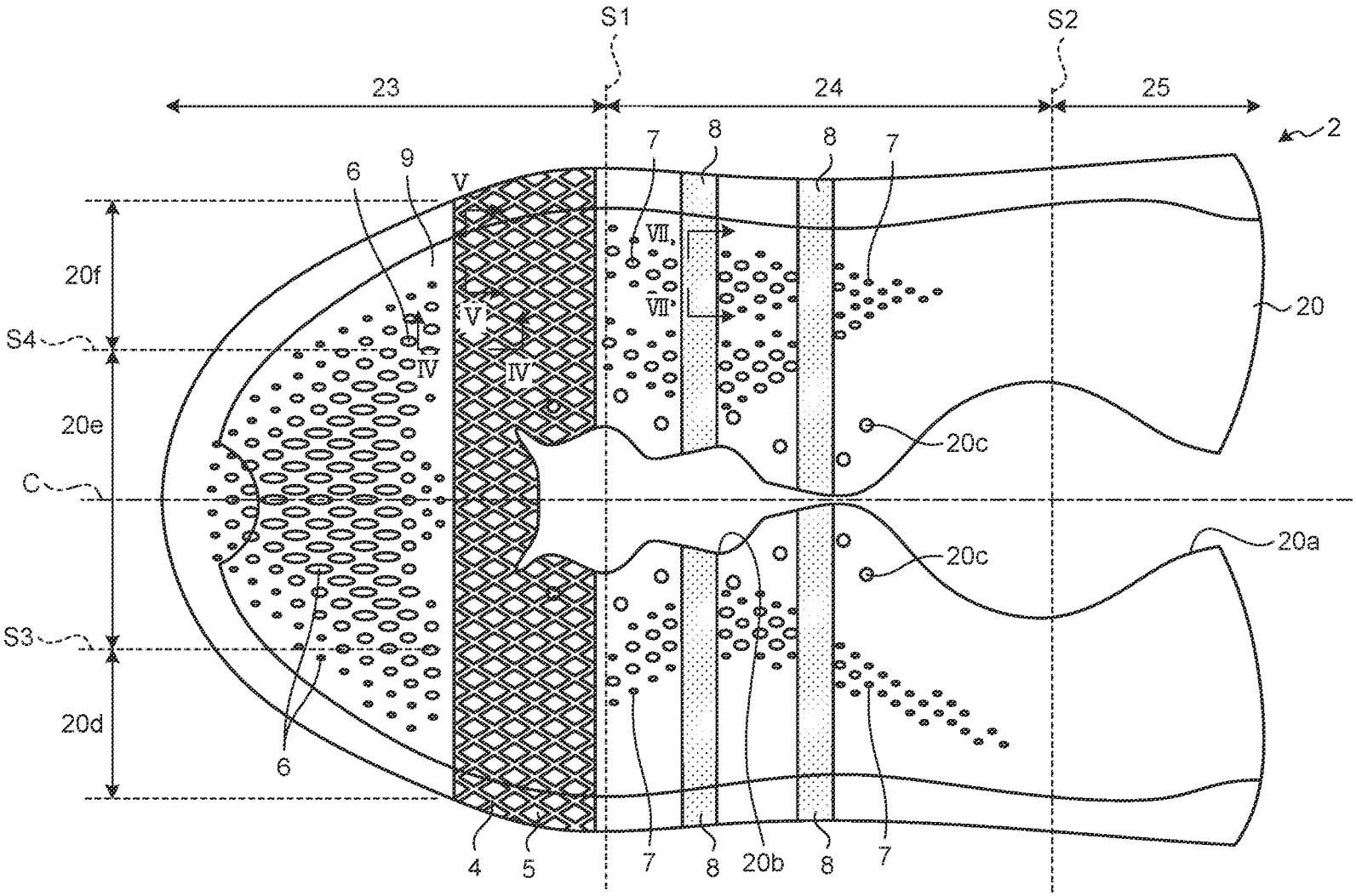
FIG. 3 is a developed view of an upper according to the first embodiment.
Figure 4:
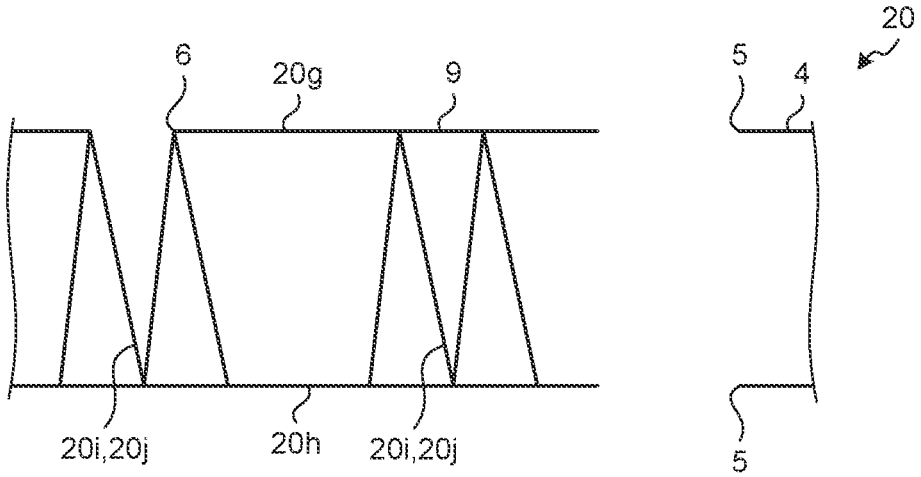
FIG. 4 is a cross-sectional view taken along line IV-IV in FIG. 3.
Figure 5:
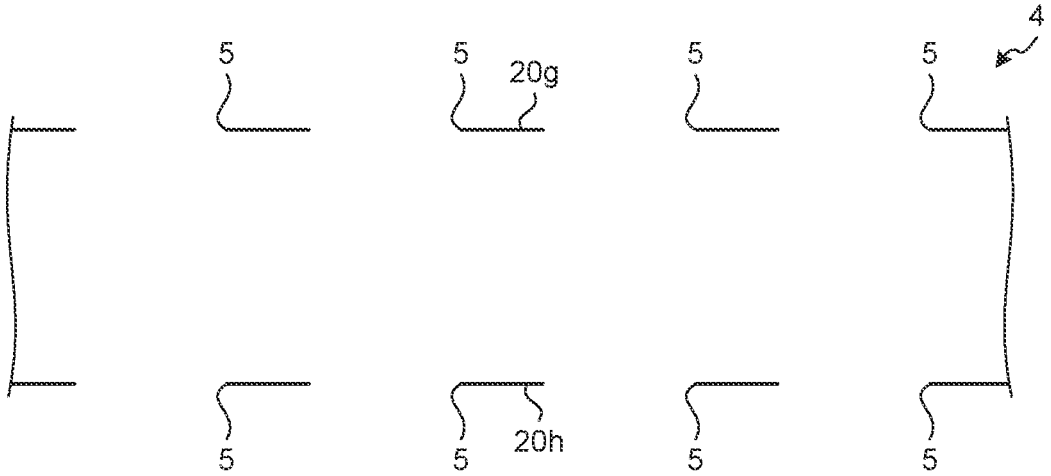
FIG. 5 is a cross-sectional view taken along line V-V in FIG. 3.
Figure 6:
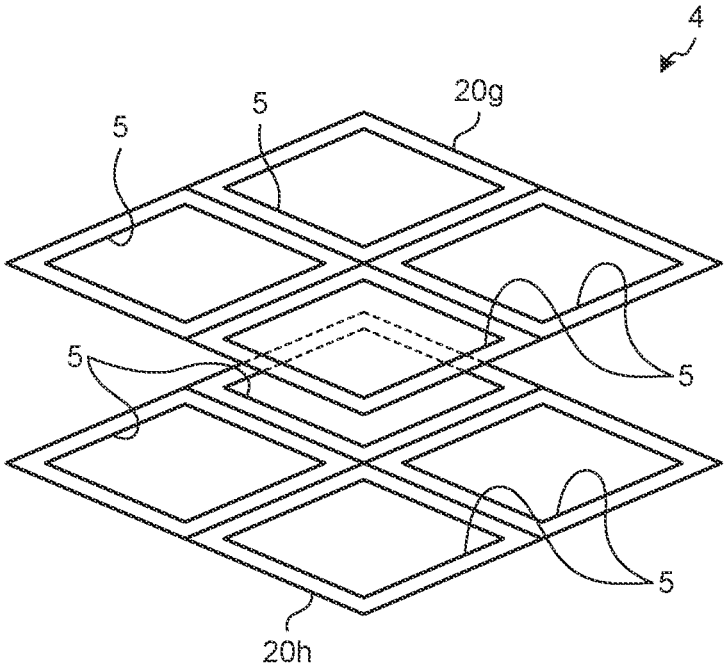
FIG. 6 is a perspective view schematically illustrating a part of a low stiffness region.
Figure 7:
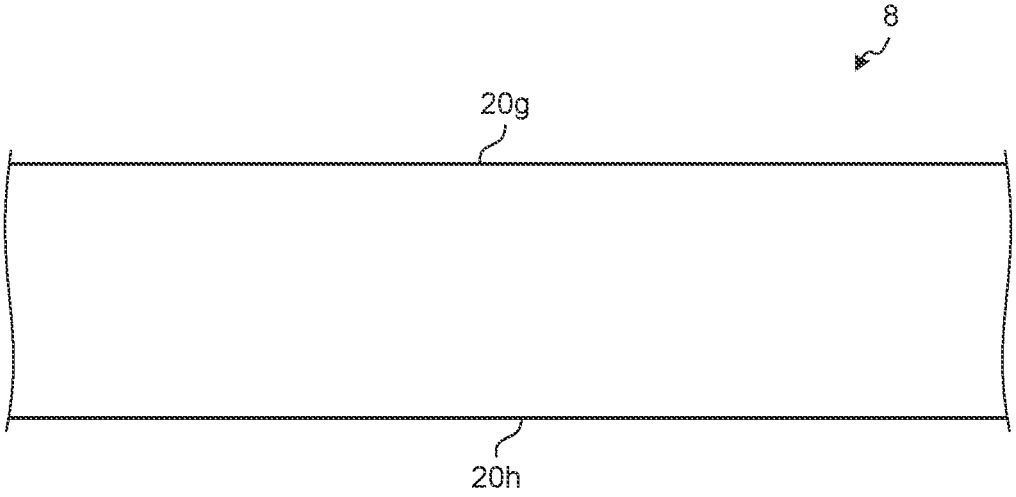
FIG. 7 is a cross-sectional view taken along line VII-VII in FIG. 3.

Next, the structure of the upper 2 is described in more detail with reference to FIGS. 3 to 7. FIG. 3 is a developed view of the upper 2 according to the first embodiment. FIG. 4 is a cross-sectional view taken along line IV-IV in FIG. 3. FIG. 5 is a cross-sectional view taken along line V-V in FIG. 3. FIG. 6 is a perspective view schematically illustrating a part of the low stiffness region 4. FIG. 7 is a cross-sectional view taken along line VII-VII in FIG. 3.

As illustrated in FIG. 3, the upper body 20 includes an upper forefoot portion 23 which is a portion covering a forefoot of a foot of a wearer with a standard body shape, an upper midfoot portion 24 which is a portion covering a midfoot of a foot of a wearer with a standard body shape, and an upper rearfoot portion 25 which is a portion covering a rearfoot of a foot of a wearer with a standard body shape. The upper forefoot portion 23, the upper midfoot portion 24, and the upper rearfoot portion 25 are connected in this order in the front-rear direction from the front side of the upper body 20. The upper forefoot portion 23 is positioned in front of the first boundary line S1. The upper midfoot portion 24 is positioned between the first boundary line S1 and the second boundary line S2. The upper rearfoot portion 25 is positioned behind the second boundary line S2. In a region of the upper forefoot portion 23 in front of the low stiffness region 4, a line along the front-rear direction passing through a position corresponding to 50% of the dimension in the foot width direction from a shoe center axis C to the edge on the lateral-most foot side is defined as a third boundary line S3, and a line along the front-rear direction passing through a position corresponding to 50% of the dimension in the foot width direction from the shoe center axis C to the edge on the medial-most foot side is defined as a fourth boundary line S4. In this case, a portion positioned on the lateral foot side from the third boundary line S3 is referred to as a lateral-foot-side side face portion 20*d* of the upper body 20, a portion sandwiched between the third boundary line S3 and the fourth boundary line S4 is referred to as a center portion 20*e* of the upper body 20, and a portion positioned on the medial foot side from the fourth boundary line S4 is referred to as a medial-foot-side side face portion 20*f* of the upper body 20.

As illustrated in FIG. 4, the upper body 20 includes a first layer 20*g*, a second layer 20*h* disposed with a gap from the first layer 20*g*, and a third layer 20*i* connecting the first layer 20*g* and the second layer 20*h*. The first layer 20*g*, the second layer 20*h*, and the third layer 20*i* are integrally disposed of a single material. The first layer 20*g* is a layer facing the outside of the upper body 20. The second layer 20*h* is a layer facing the inside of the upper body 20. The third layer 20*i* includes a plurality of linear bodies 20*j*. Each linear body 20*j* is disposed to reciprocate a plurality of times between the first layer 20*g* and the second layer 20*h*. Each linear body 20*j* is, for example, a fiber, a thread obtained by bundling a plurality of fibers, or the like. Hereinafter, a direction in which the first layer 20*g*, the second layer 20*h*, and the third layer 20*i* are stacked is referred to as a stacking direction.

As illustrated in FIG. 3, the upper body 20 is disposed with the low stiffness region 4, a plurality of first through holes 6, a plurality of second through holes 7, and a plurality of non-hole regions 8. In FIG. 3, the non-hole regions 8 are illustrated with dot hatching in order to clarify the ranges of the non-hole regions 8. The number of the first through holes 6 and the number of the second through holes 7 may be appropriately increased or decreased, and FIG. 3 illustrates a case in which the number of the first through holes 6 and the number of the second through holes 7 are different from those in FIGS. 1 and 2. The low stiffness region 4 is disposed in the upper forefoot portion 23 and extends in the foot width direction. The low stiffness region 4 is disposed from the lateral-foot-side boundary of the upper body 20 with the sole 3 illustrated in FIG. 2 through the front of the opening 20*b* to the medial-foot-side boundary with the sole 3. The shape of the low stiffness region 4 in plan view is not particularly limited, but is substantially band-shaped in the present embodiment.

As illustrated in FIG. 5, the third layer 20*i* is not disposed in the low stiffness region 4. That is, in the present embodiment, the third layer 20*i* is not disposed over the entire low stiffness region 4. A plurality of holes 5 is disposed in a portion of the first layer 20*g* and the second layer 20*h* of the low stiffness region 4 corresponding to the point in which the third layer 20*i* is not disposed. As illustrated in FIG. 6, the holes 5 have substantially the same shape in the first layer 20*g* and the second layer 20*h* at positions corresponding to each other in the stacking direction. The shape of the holes 5 in plan view is a rhombus in the present embodiment. In the present specification, "substantially the same shape" means a state in which the shape and the opening area of the holes 5 are completely the same between the first layer 20*g* and the second layer 20*h*, a state in which the shape and the opening area of the holes 5 are not strictly the same but slightly different between the first layer 20*g* and the second layer 20*h* due to a manufacturing error or the like, and a state in which the opening area of the holes 5 is originally intentionally made different between the first layer 20*g* and the second layer 20*h*.

As illustrated in FIG. 3, the first through holes 6 are disposed in the upper forefoot portion 23 in front of the low stiffness region 4. The first through holes 6 are disposed with a space from each other in the front-rear direction and the foot width direction. The shape of the first through holes 6 in plan view is not particularly limited, but is a circle or an ellipse in the present embodiment. Here, the total opening area of the first through holes 6 positioned in the center portion 20*e* of the upper body 20 in the foot width direction is defined as a first total opening area, and the total opening area of the first through holes 6 positioned in the lateral-foot-side side face portion 20*d* and the medial-foot-side side face portion 20*f* of the upper body 20 in the foot width direction is defined as a second total opening area. The first total opening area is larger than the second total opening area. As illustrated in FIG. 4, the first through holes 6 are disposed only in the first layer 20*g*. The third layer 20*i* is disposed at positions corresponding to the first through holes 6 in the stacking direction.

As illustrated in FIG. 3, the second through holes 7 are disposed in the upper midfoot portion 24 behind the low stiffness region 4. The second through holes 7 are disposed on both sides in the foot width direction across the opening 20*b* and the foot insertion opening 20*a*. The second through holes 7 are disposed from the vicinity of the rear end of the low stiffness region 4 over the rear side from the non-hole region 8 positioned rearmost. The second through holes 7 are not disposed in the portion with the non-hole regions 8. The second through holes 7 are disposed with a space from each other in the front-rear direction and the foot width direction. The shape of the second through holes 7 in plan view is not particularly limited, but is a circle or an ellipse in the present embodiment. Although not illustrated, similarly to the first through holes 6, the second through holes 7 are disposed only in the first layer 20*g*, and the third layer 20*i* is disposed at positions corresponding to the second through holes 7 in the stacking direction. Since, in the low stiffness region 4, the holes 5 are disposed in the first layer 20*g* and the second layer 20*h*, and the third layer 20*i* is not disposed at the positions corresponding to the holes 5 in the stacking direction, the stiffness of the low stiffness region 4 is lower than the stiffness of the region where the first through holes 6 and the second through holes 7 are disposed.

The non-hole regions 8 are disposed in the upper midfoot portion 24 and extends in the foot width direction. The non-hole regions 8 are disposed on both sides in the foot width direction across the opening 20*b*. The non-hole regions 8 are disposed at right-left symmetrical positions across the opening 20*b*. The number of the non-hole regions 8 is not particularly limited, but there are four non-hole regions 8 in the present embodiment; two of them are disposed on the lateral foot side of the opening 20*b*, and the other two are disposed on the medial foot side. The two non-hole regions 8 positioned on the lateral foot side are disposed with a space from each other in the front-rear direction. The two non-hole regions 8 positioned on the medial foot side are disposed with a space from each other in the front-rear direction. As illustrated in FIG. 7, in each non-hole region 8, there are no holes in the first layer 20*g* and the second layer 20*h*, and the third layer 20*i* is not disposed over the entire region. Since, in the low stiffness region 4, the holes 5 are disposed in the first layer 20*g* and the second layer 20*h*, and the third layer 20*i* is not disposed at positions corresponding to the holes 5 in the stacking direction, the stiffness of the low stiffness region 4 is lower than the stiffness of the non-hole regions 8.

In a standard region 9 of the upper body 20 other than the low stiffness region 4, the first through holes 6, the second through holes 7, and the non-hole regions 8 illustrated in FIG. 3, there are no holes in the first layer 20*g* and the second layer 20*h*, and the third layer 20*i* is disposed. The low stiffness region 4 is adjacent to the standard region 9 in the present embodiment. The low stiffness region 4 has lower stiffness than the adjacent standard region 9.

Next, an effect of the upper 2 according to the present embodiment is described.

In the present embodiment, the upper 2 includes the upper body 20 that covers the instep of a foot as illustrated in FIG. 1, and the upper body 20 includes the first layer 20*g*, the second layer 20*h* disposed with a gap from the first layer 20*g*, and the third layer 20*i* connecting the first layer 20*g* and the second layer 20*h* as illustrated in FIG. 4. As illustrated in FIG. 5, a part of the upper body 20 is disposed with the low stiffness region 4 having lower stiffness than the adjacent region, and the third layer 20*i* is not disposed in the low stiffness region 4. A plurality of holes 5 is disposed in a portion of the first layer 20*g* and the second layer 20*h* of the low stiffness region 4 corresponding to the point in which the third layer 20*i* is not disposed. With these structures, the stiffness of the low stiffness region 4 is lower than that with the conventional technique in which the holes 5 are not disposed in the first layer 20*g* and the second layer 20*h*, and it is possible to locally reduce the stiffness of the upper body 20 as compared with a conventional upper. Then, by disposing the low stiffness region 4 in a portion where bending or twisting of a foot occurs during movement, it is possible to enhance the followability of the upper body 20 with respect to bending or twisting of the foot of a wearer.

When the upper rearfoot portion 25 is lifted off the ground while the upper forefoot portion 23 illustrated in FIG. 3 is in contact with the ground, the forefoot of a foot bends, which generates a bending point in the upper forefoot portion 23. In the present embodiment, since the low stiffness region 4 is disposed in the upper forefoot portion 23 where the bending point is generated, it is possible to reduce the bending stiffness of the portion of the upper forefoot portion 23 where the bending point is generated. Accordingly, it is possible to reduce bending resistance of the upper body 20 during bending of a foot. In addition, since the low stiffness region 4 is easily deformed following the bending of the foot, it is possible to ease the contact of the upper body 20 with the foot and reduce wrinkles generated in the upper body 20.

In the present embodiment, the holes 5 have substantially the same shape in the first layer 20*g* and the second layer 20*h* at the positions corresponding to each other as illustrated in FIG. 6, which makes it easier to deform the first layer 20*g* and the second layer 20*h* in the low stiffness region 4 in the same manner.

In the present embodiment, since the shape of the holes 5 in plan view is a rhombus as illustrated in FIG. 6, the space between the opposite vertices of each hole 5 widens, which makes it easier for the first layer 20*g* and the second layer 20*h* to stretch, and the space between the opposite vertices of each hole 5 narrows, which makes it easier for the first layer 20*g* and the second layer 20*h* to shrink. Therefore, the first layer 20*g* and the second layer 20*h* in the low stiffness region 4 are easily deformed following stretching and shrinking of the skin of a foot during movement. Accordingly, it is possible to improve the fitting of the upper body 20 to the foot. Such an effect can be achieved even when the shape of the holes 5 in a plan view is a 2n-polygon (n is an integer of 2 or more) other than a rhombus. If the opening area of the rhombic holes 5 is the same as the opening area of the 2n-polygonal holes 5 other than rhombic holes, the rhombic holes 5 have an advantage of having the largest mechanical deformation between the opposite vertices as compared with the 2n-polygonal holes 5 other than rhombic holes and of being most easily manufactured by a manufacturing machine that weaves the upper body 20.

In the present embodiment, since the upper body 20 illustrated in FIG. 4 is disposed of a single material, it is possible to easily manufacture the upper body 20 including the holes 5.

Figure 8:
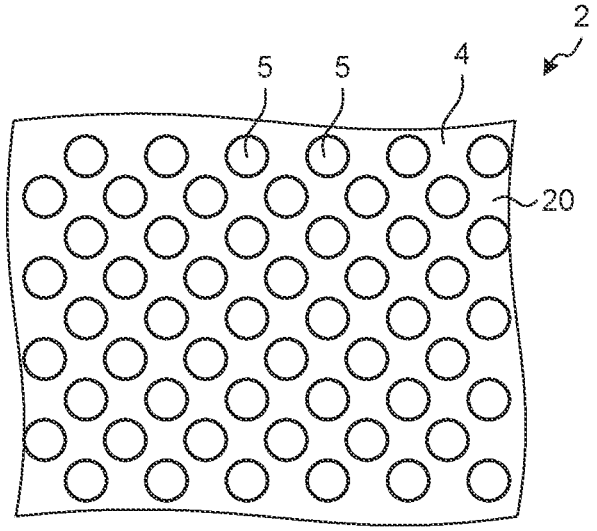
FIG. 8 is a partially enlarged plan view of a low stiffness region of an upper according to a first modification of the first embodiment.
Figure 9:
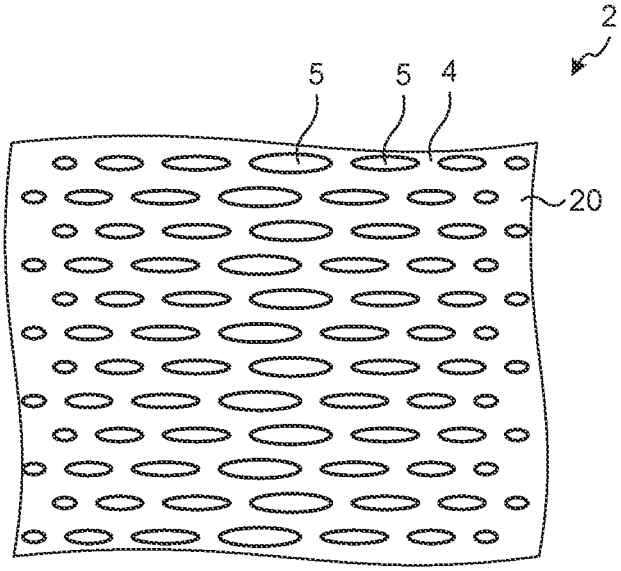
FIG. 9 is a partially enlarged plan view of a low stiffness region of an upper according to a second modification of the first embodiment.

In the present embodiment, the case in which the shape of the holes 5 in plan view is a rhombus has been described as an example, but there is no intension to limit the shape of the holes 5 in plan view. FIG. 8 is a partially enlarged plan view of the low stiffness region 4 of the upper 2 according to a first modification of the first embodiment. The shape of the holes 5 in plan view may be, for example, a circle illustrated in FIG. 8. In FIG. 8, all the holes 5 have the same size, but the sizes of some or all of the holes 5 may be different. FIG. 9 is a partially enlarged plan view of the low stiffness region 4 of the upper 2 according to a second modification of the first embodiment. The shape of the holes 5 in plan view may be, for example, an ellipse illustrated in FIG. 9. In FIG. 9, the sizes of some of the holes 5 are different, but the sizes of all the holes 5 may be the same or different. Even if the shape of the holes 5 in plan view is a circle or an ellipse in this manner, it is possible to obtain an effect similar to that in the case in which the shape of the holes 5 in plan view is a 2n-polygon. Note that a mixture of two or more types of holes 5 of circular, elliptical, and 2n-polygonal shapes may be disposed in the low stiffness region 4.

In the present embodiment, all the holes 5 have substantially the same shape in the first layer 20*g* and the second layer 20*h* at positions corresponding to each other in the stacking direction as illustrated in FIG. 6, but at least one of the holes 5 is only required to have substantially the same shape in the first layer 20*g* and the second layer 20*h* at positions corresponding to each other in the stacking direction. Note that, as the number of the holes 5 having substantially the same shape in the first layer 20*g* and the second layer 20*h* at the positions corresponding to each other in the stacking direction are increased, the first layer 20*g* and the second layer 20*h* in the low stiffness region 4 are more easily deformed in the same manner.

Although the third layer 20*i* is not disposed over the entire low stiffness region 4 as illustrated in FIG. 5 in the present embodiment, it is only required that at least a part of the low stiffness region 4 has a point in which the third layer 20*i* is not disposed.

Second Embodiment

Figure 10:
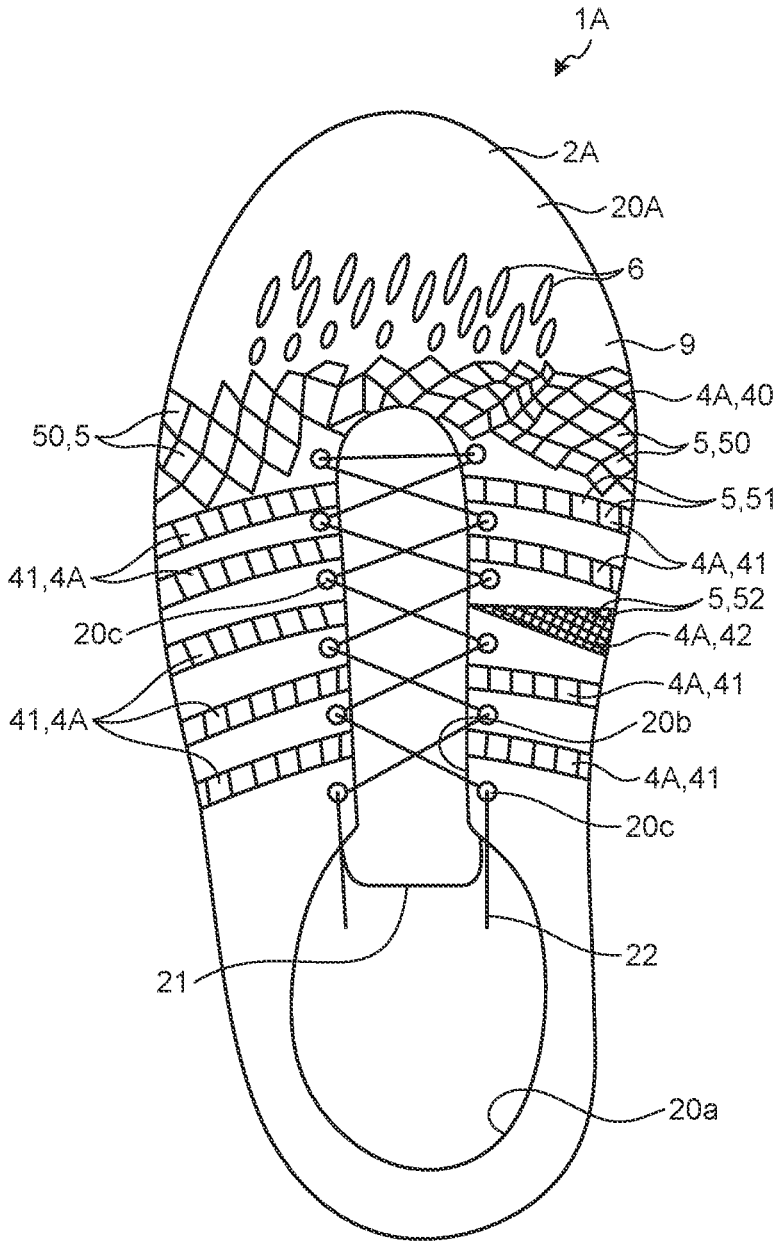
FIG. 10 is a plan view of a shoe according to a second embodiment of the present invention.
Figure 11:
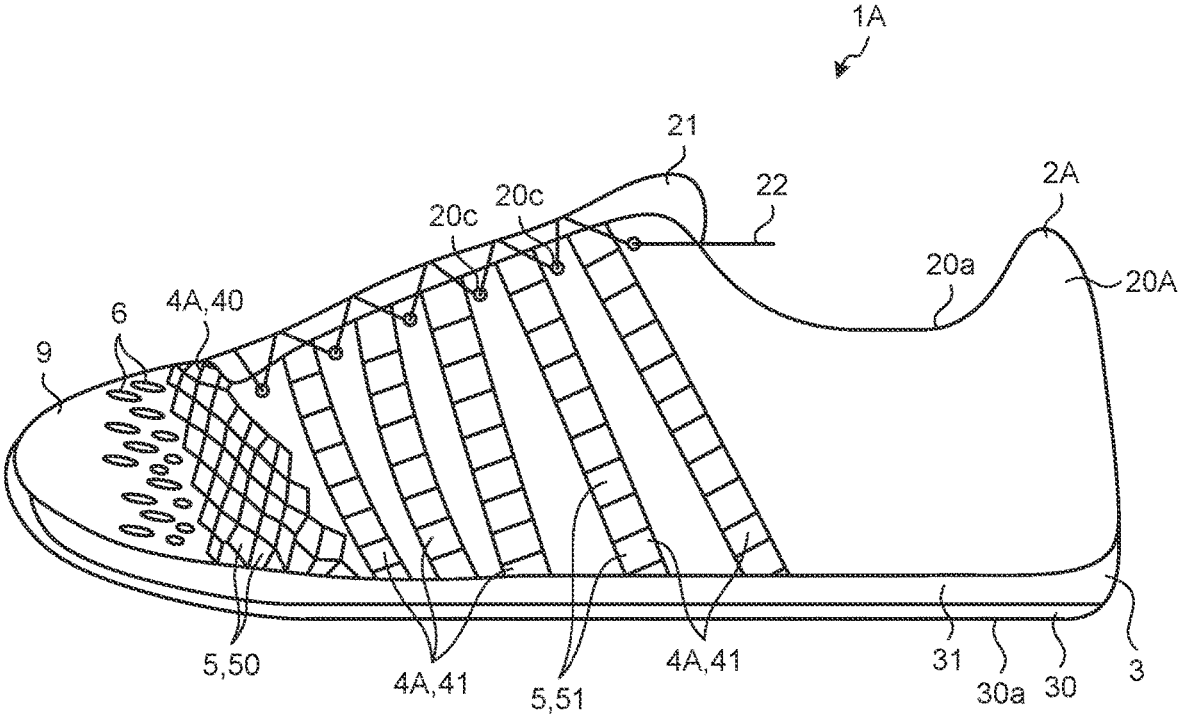
FIG. 11 is a side view of the shoe on a lateral foot side according to the second embodiment.

FIG. 10 is a plan view of a shoe 1A according to a second embodiment of the present invention. FIG. 11 is a side view of the shoe 1A on a lateral foot side according to the second embodiment. An upper 2A of the shoe 1A according to the second embodiment is different from the upper 2 according to the first embodiment in the structure of a low stiffness region 4A and in that the second through holes 7 and the non-hole regions 8 are omitted. In the second embodiment, portions that overlap with the first embodiment described above are denoted by the same reference signs, and the descriptions thereof are omitted.

The low stiffness region 4A includes a first low stiffness region 40, a second low stiffness region 41, and a third low stiffness region 42. Holes 5 includes a plurality of first holes 50, a plurality of second holes 51, and a plurality of third holes 52. The first holes 50 are disposed side by side in the front-rear direction and the foot width direction in the first low stiffness region 40. The shape of first holes 50 in plan view is not particularly limited, but is a rhombus in the present embodiment. The second holes 51 are disposed side by side in the foot width direction in the second low stiffness region 41. The shape of second holes 51 in plan view is not particularly limited, but is a square or a rectangle in the present embodiment. The third holes 52 are disposed side by side in the front-rear direction and the foot width direction in the third low stiffness region 42. The shape of third holes 52 in plan view is not particularly limited, but is a rhombus in the present embodiment.

Figure 12:
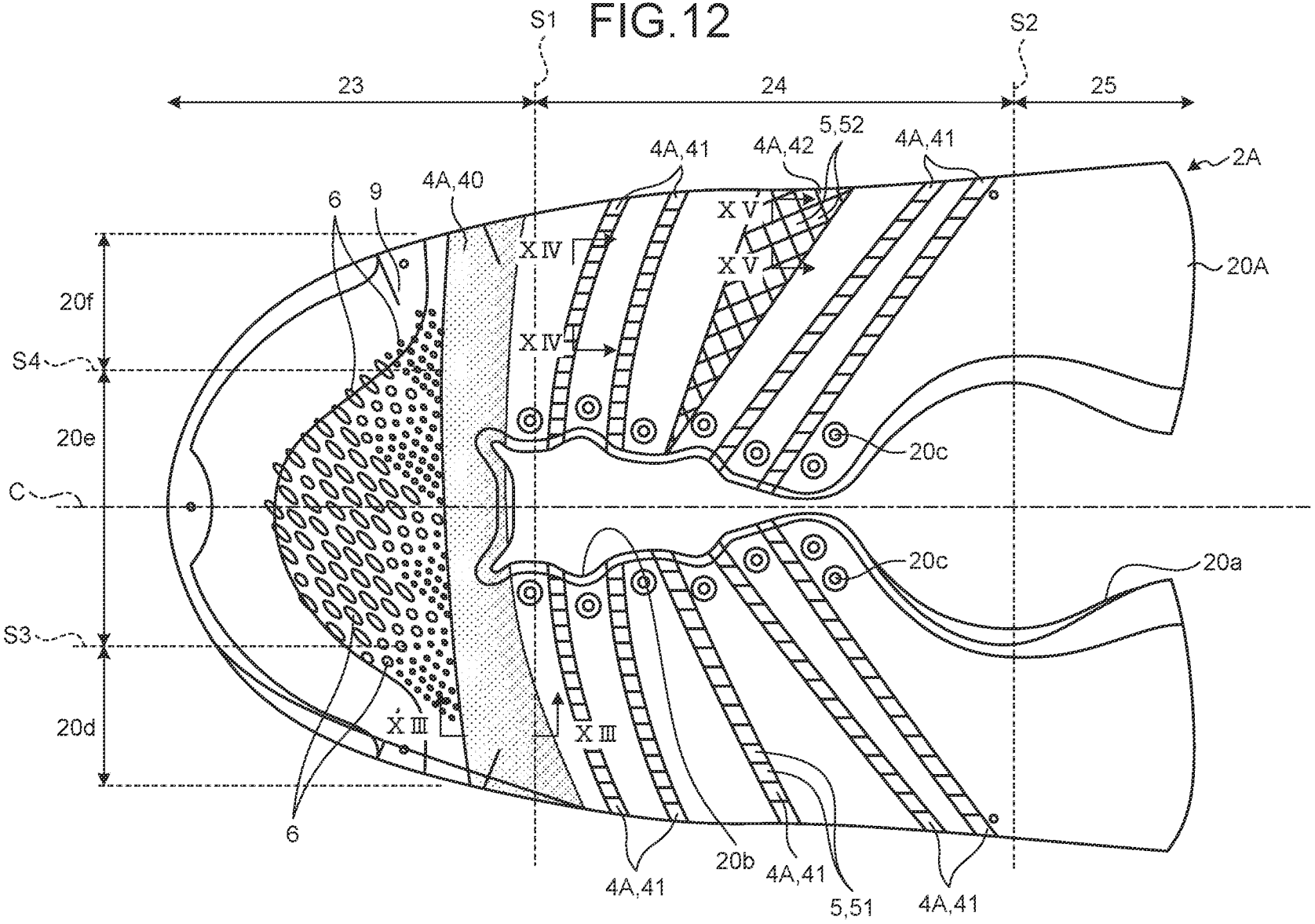
FIG. 12 is a developed view of an upper according to the second embodiment.
Figure 13:
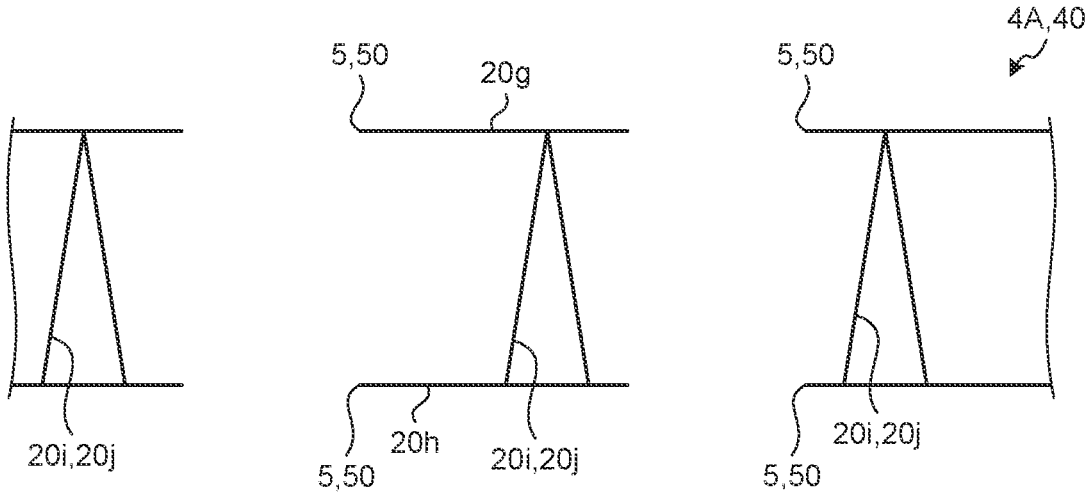
FIG. 13 is a cross-sectional view taken along line XIII-XIII in FIG. 12.

FIG. 12 is a developed view of the upper 2A according to the second embodiment. Note that the number of first through holes 6 may be appropriately increased or decreased, and FIG. 12 illustrates a case in which the number of the first through holes 6 is different from that in FIGS. 10 and 11. In FIG. 12, the first low stiffness region 40 is illustrated with dot hatching for convenience of description. The first low stiffness region 40 is disposed in an upper forefoot portion 23 and extends in the foot width direction. The first low stiffness region 40 is disposed from the lateral-foot-side boundary of the upper body 20A with a sole 3 illustrated in FIG. 11 through the front of an opening 20*b* to the medial-foot-side boundary with the sole 3. The shape of the first low stiffness region 40 in plan view is not particularly limited, but is substantially band-shaped in the present embodiment. FIG. 13 is a cross-sectional view taken along line XIII-XIII in FIG. 12. As illustrated in FIG. 13, the first low stiffness region 40 has a point in which a third layer 20*i* is disposed and a point in which the third layer 20*i* is not disposed. The first holes 50 are disposed in a portion of a first layer 20*g* and a second layer 20*h* of the first low stiffness region 40 corresponding to the point in which the third layer 20*i* is not disposed. The first holes 50 have substantially the same shape in the first layer 20*g* and the second layer 20*h* at positions corresponding to each other in the stacking direction.

The shade of dot hatching illustrated in FIG. 12 represents a change in the density of linear bodies 20*j* illustrated in FIG. 13 in the first low stiffness region 40. In the present embodiment, the density of the linear bodies 20*j* increases from the front side toward the rear side. For example, by designing the number of the linear bodies 20*j* to be zero at the front end of the first low stiffness region 40 and narrowing the space in the front-rear direction between adjacent linear bodies 20*j* from the front side toward the rear side, the density of the linear bodies 20*j* can increase from the front side toward the rear side. In the present embodiment, since the density of the linear bodies 20*j* is increased from the front side toward the rear side, the stiffness of the first low stiffness region 40 increases from the front side toward the rear side. A region in which the first through holes 6 are disposed is adjacent to the front side of the first low stiffness region 40, and a standard region 9 is adjacent to the rear side of the first low stiffness region 40. Since the stiffness of the first low stiffness region 40 increases from the front side toward the rear side, it is possible to reduce the difference between the stiffness of the first low stiffness region 40 and the stiffness of the region in which the first through holes 6 are disposed and to reduce the difference between the stiffness of the first low stiffness region 40 and the stiffness of the standard region 9. Note that the density of the linear bodies 20*j* may increase from the rear side toward the front side. That is, the density of the linear bodies 20*j* is only required to increase from one side to the other side in the front-rear direction. The density of the linear bodies 20*j* is only required to be appropriately adjusted to reduce the difference between the stiffness of the first low stiffness region 40 and the stiffness of the adjacent regions in front of and behind the first low stiffness region 40.

The second low stiffness region 41 is disposed in an upper midfoot portion 24 and extends in the foot width direction. The second low stiffness region 41 is disposed on both sides in the foot width direction across the opening 20*b* and a foot insertion opening 20*a*. The shape of the second low stiffness region 41 in plan view is not particularly limited, but is substantially band-shaped in the present embodiment. The second low stiffness region 41 positioned on the lateral foot side of the opening 20*b* is disposed from the lateral-foot-side side edge of the opening 20*b* to the lateral-foot-side boundary of the upper body 20A with the sole 3. The number of second low stiffness regions 41 positioned on the lateral foot side of the opening 20*b* is not particularly limited, but is five in the present embodiment. The five second low stiffness regions 41 are disposed with a space from each other in the front-rear direction. The second low stiffness region 41 positioned on the medial foot side of the opening 20*b* is disposed from the medial-foot-side side edge of the opening 20*b* to the medial-foot-side boundary of the upper body 20A with the sole 3. The number of second low stiffness regions 41 positioned on the medial foot side of the opening 20*b* is not particularly limited, but is four in the present embodiment. The four second low stiffness regions 41 are disposed with a space from each other in the front-rear direction.

Figure 14:
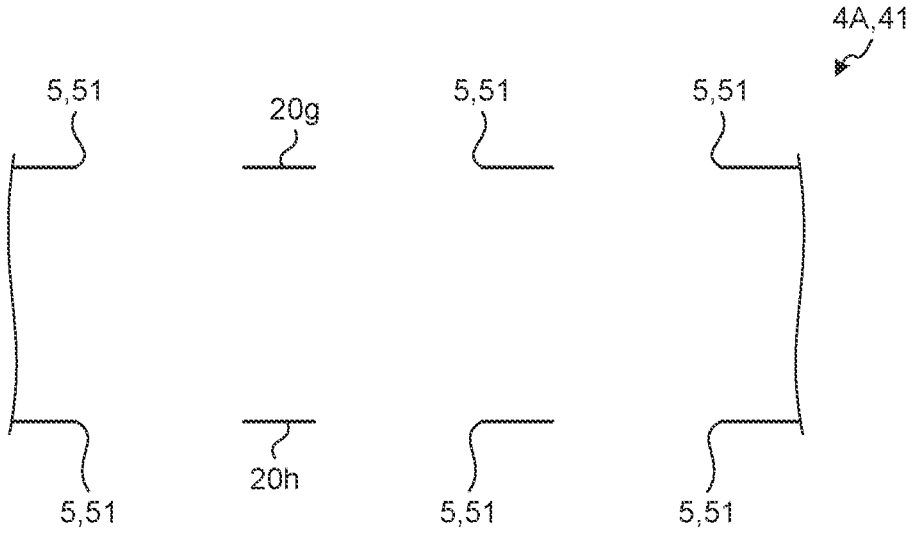
FIG. 14 is a cross-sectional view taken along line XIV-XIV in FIG. 12.

FIG. 14 is a cross-sectional view taken along line XIV-XIV in FIG. 12. As illustrated in FIG. 14, the third layer 20*i* is not disposed in the second low stiffness region 41. That is, in the present embodiment, the third layer 20*i* is not disposed over the entire second low stiffness regions 41. The second holes 51 are disposed in a portion of the first layer 20*g* and the second layer 20*h* of the low stiffness region 4A corresponding to the point in which the third layer 20*i* is not disposed. The second holes 51 have substantially the same shape in the first layer 20*g* and the second layer 20*h* at positions corresponding to each other in the stacking direction.

As illustrated in FIG. 12, the third low stiffness region 42 is disposed in the upper midfoot portion 24 and extends in the foot width direction. The third low stiffness region 42 is disposed on the medial foot side of the opening 20*b*. The third low stiffness region 42 is disposed from the medial-foot-side side edge of the opening 20*b* to the medial-foot-side boundary of the upper body 20A with the sole 3. The shape of the third low stiffness region 42 in plan view is not particularly limited, but is a triangle in the present embodiment. The width along the front-rear direction of the third low stiffness region 42 is widened from the shoe center axis C side toward the medial foot side. The number of third low stiffness regions 42 is not particularly limited, but is one in the present embodiment. The third low stiffness region 42 is disposed between the second low stiffness region 41 positioned second from the front side and the second low stiffness region 41 positioned third from the front side. That is, two of the four second low stiffness regions 41 are disposed in front of the third low stiffness region 42, and the other two is disposed behind the third low stiffness region 42.

Figure 15:
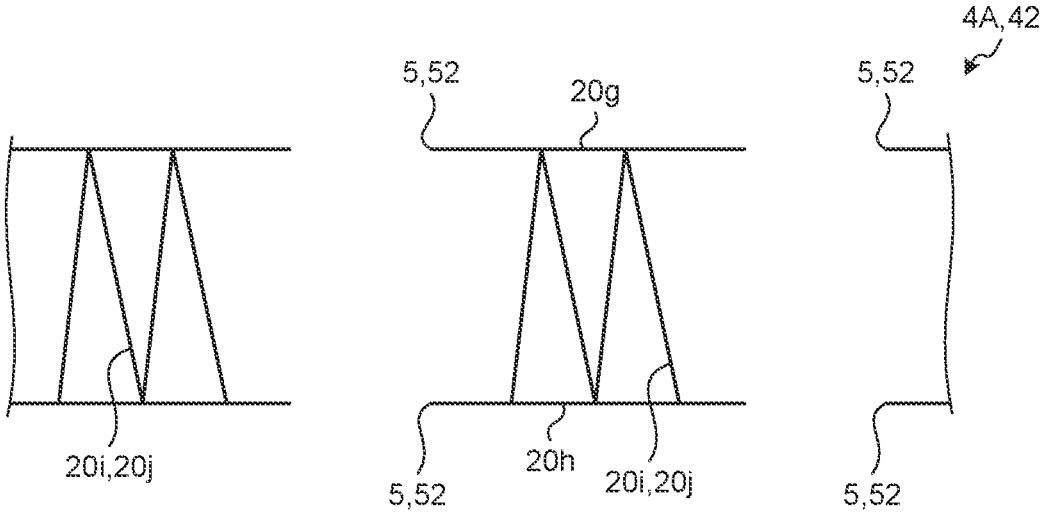
FIG. 15 is a cross-sectional view taken along line XV-XV in FIG. 12.

FIG. 15 is a cross-sectional view taken along line XV-XV in FIG. 12. As illustrated in FIG. 15, the third low stiffness region 42 has a point in which the third layer 20*i* is disposed and a point in which the third layer 20*i* is not disposed. In the third low stiffness region 42, the point in which the third layer 20*i* is disposed and the point in which the third layer 20*i* is not disposed are alternately disposed along the foot width direction. The third holes 52 are disposed in a portion of the first layer 20*g* and the second layer 20*h* of the third low stiffness region 42 corresponding to the point in which the third layer 20*i* is not disposed. The third holes 52 have substantially the same shape in the first layer 20*g* and the second layer 20*h* at positions corresponding to each other in the stacking direction.

Next, an effect of the upper 2A according to the present embodiment is described.

In the present embodiment, since the low stiffness region 4A includes the first low stiffness region 40 disposed in the upper forefoot portion 23 in which the bending point is generated as illustrated in FIG. 12, it is possible to reduce the bending stiffness of the portion of the upper forefoot portion 23 where the bending point is generated. Accordingly, it is possible to reduce bending resistance of the upper body 20A during bending of a foot. In addition, since the first low stiffness region 40 is easily deformed following the bending of the foot, it is possible to ease the contact of the upper body 20A with the foot and reduce wrinkles generated in the upper body 20A.

In the present embodiment, as illustrated in FIG. 11, the holes 5 includes the first holes 50 disposed side by side in the front-rear direction and the foot width direction in the first low stiffness region 40, and the shape of the first holes 50 is a rhombus. Accordingly, the space between the opposite vertices of each first hole 50 widens, which makes it easier for the first layer 20*g* and the second layer 20*h* to stretch as illustrated in FIG. 13, and the space between the opposite vertices of each first hole 50 narrows, which makes it easier for the first layer 20*g* and the second layer 20*h* to shrink. Therefore, it is possible for the first layer 20*g* and the second layer 20*h* in the first low stiffness region 40 to be easily deformed following stretching and shrinking of the skin of a foot during movement. For this reason, it is possible to improve the fitting of the upper body 20A to the foot. A similar effect can be obtained also in the third low stiffness region 42 in which the rhombic third holes 52 illustrated in FIG. 12 are disposed.

In the present embodiment, since the third layer 20*i* includes the linear bodies 20*j* as illustrated in FIG. 13, and the density of the linear bodies 20*j* in the first low stiffness region 40 increases from one side to the other side in the front-rear direction, it is possible to reduce the difference between the stiffness of the first low stiffness region 40 and the stiffness of the adjacent regions in front of and behind the first low stiffness region 40. Therefore, it is possible to control the change in the contact of the upper body 20A with a foot in the first low stiffness region 40 and the adjacent regions in front of and behind the first low stiffness region 40.

During movement, the skin of the midfoot of a foot distorts, and the upper midfoot portion 24 illustrated in FIG. 12 is sheared and deformed. In the present embodiment, since the low stiffness region 4A includes the second low stiffness regions 41 and the third low stiffness region 42 disposed in the upper midfoot portion 24, it is possible to reduce the torsional stiffness of the upper midfoot portion 24. Accordingly, since the second low stiffness regions 41 and the third low stiffness region 42 are easily deformed following the distortion of the foot, it is possible to ease the contact of the upper body 20A with the foot and reduce wrinkles generated in the upper body 20A.

In the present embodiment, as illustrated in FIG. 12, the holes 5 include the second holes 51 disposed side by side in the front-rear direction and the foot width direction in the second low stiffness region 41, and the shape of the second holes 51 is a square or a rectangle. Accordingly, the first layer 20*g* and the second layer 20*h* in the second low stiffness region 41 illustrated in FIG. 14 are easily sheared and deformed. Therefore, it is possible for the first layer 20*g* and the second layer 20*h* in the second low stiffness region 41 to be easily deformed following distortion of the skin of a foot during movement. For this reason, it is possible to improve the fitting of the upper body 20A to the foot.

By using a manufacturing machine capable of manufacturing the upper body 20A illustrated in FIG. 12 with a single material and capable of changing the shape of the holes 5, the shape of the first through holes 6, and the pattern of each of the layers 20*g*, 20*h*, and 20*i*, it is possible to manufacture the upper body 20A without adding a new member. Therefore, it is possible to reduce the weight of the shoe 1A and reduce the environmental load.

Note that the shapes of the first holes 50, the second holes 51, and the third holes 52 in plan view are not limited to the illustrated examples, and may be, for example, a circle, an ellipse, or a 2n-polygon other than a rhombus, a square, and a rectangle.

At least one of the first holes 50 illustrated in FIG. 13 is only required to have substantially the same shape in the first layer 20*g* and the second layer 20*h* at positions corresponding to each other in the stacking direction. Note that, as the number of the first holes 50 having substantially the same shape in the first layer 20*g* and the second layer 20*h* at the positions corresponding to each other in the stacking direction are increased, the first layer 20*g* and the second layer 20*h* in the first low stiffness region 40 are more easily deformed in the same manner.

At least one of the second holes 51 illustrated in FIG. 14 is only required to have substantially the same shape in the first layer 20*g* and the second layer 20*h* at positions corresponding to each other in the stacking direction. Note that, as the number of the second holes 51 having substantially the same shape in the first layer 20*g* and the second layer 20*h* at the positions corresponding to each other in the stacking direction are increased, the first layer 20*g* and the second layer 20*h* in the second low stiffness region 41 are more easily deformed in the same manner.

At least one of the third holes 52 illustrated in FIG. 15 is only required to have substantially the same shape in the first layer 20*g* and the second layer 20*h* at positions corresponding to each other in the stacking direction. Note that, as the number of the third holes 52 having substantially the same shape in the first layer 20*g* and the second layer 20*h* at the positions corresponding to each other in the stacking direction are increased, the first layer 20*g* and the second layer 20*h* in the third low stiffness region 42 are more easily deformed in the same manner.

Although the third layer 20*i* is not disposed over the entire second low stiffness region 41 as illustrated in FIG. 14 in the present embodiment, it is only required that at least a part of the second low stiffness region 41 has a point in which the third layer 20*i* is not disposed. In this case, it is preferable that, in the second low stiffness region 41, a point in which the third layer 20*i* is disposed and a point in which the third layer 20*i* is not disposed are alternately disposed along the foot width direction. Although there is a point in which the third layer 20*i* is not disposed in a part of each of the first low stiffness region 40 illustrated in FIG. 13 and the third low stiffness region 42 illustrated in FIG. 15 in the present embodiment, but the third layer 20*i* may not be disposed over the entire region of each of the first low stiffness region 40 and the third low stiffness region 42.

The configurations described in the above embodiments merely show examples of the present invention and can be combined with another known technique, and a part of each configuration can be omitted or changed without departing from the gist of the present invention. In the first and second embodiments described above, the upper bodies 20 and 20A are disposed of a single material, but the upper bodies 20 and 20A may be disposed by combining a plurality of materials.

REFERENCE SIGNS LIST

1, 1A SHOE
2, 2A UPPER
3 SOLE
4, 4A LOW STIFFNESS REGION
5 HOLE
6 FIRST THROUGH HOLE
7 SECOND THROUGH HOLE
8 NON-HOLE REGION
9 STANDARD REGION
20, 20A UPPER BODY
20*a* FOOT INSERTION OPENING
20*b* OPENING
20*c* STRING PASSING PORTION
20*d* LATERAL-FOOT-SIDE SIDE FACE PORTION
20*e* CENTER PORTION
20*f* MEDIAL-FOOT-SIDE SIDE FACE PORTION
20*g* FIRST LAYER
20*h* SECOND LAYER
20*i* THIRD LAYER
20*j* LINEAR BODY
21 SHOE TONGUE
22 SHOELACE
23 UPPER FOREFOOT PORTION
24 UPPER MIDFOOT PORTION
25 UPPER REARFOOT PORTION
30 OUTSOLE
30*a* GROUND CONTACT SURFACE
31 MIDSOLE
40 FIRST LOW STIFFNESS REGION
41 SECOND LOW STIFFNESS REGION
42 THIRD LOW STIFFNESS REGION
50 FIRST HOLE
51 SECOND HOLE
52 THIRD HOLE

The invention claimed is:

1. An upper comprising
an upper body covering an instep of a foot, wherein
the upper body includes a first layer, a second layer disposed with a gap from the first layer, and a third layer connecting the first layer and the second layer,
the upper body includes a standard region, a non-hole region having a lower stiffness than the standard region, and a low stiffness region having a lower stiffness than the non-hole region,
the first layer and the second layer have no hole in the standard region,
the third layer is not disposed in the non-hole region,
the first layer and the second layer have no hole in the non-hole region,
the third layer is not disposed in the low stiffness region,
at least one hole is disposed in each of the first layer and the second layer in the low stiffness region, and
the at least one hole in the first layer and the at least one hole in the second layer are disposed at a corresponding position in the low stiffness region.

2. The upper according to claim 1, wherein the at least one hole in the first layer and the at least one hole in the second layer have a same shape.

3. The upper according to claim 1, wherein a shape of the at least one hole in the first layer and the at least one hole in the second layer are a circle, an ellipse, or a 2n-polygon (n is an integer of 2 or more).

4. The upper according to claim 1, wherein
the upper body includes an upper forefoot portion adapted to cover a forefoot of the foot, and
the low stiffness region includes a first low stiffness region disposed in the upper forefoot portion.

5. The upper according to claim 1, wherein
the at least one hole in the first layer includes a plurality of holes disposed with a space from each other in a front-rear direction and a foot width direction, and
a total opening area of the plurality of holes in a center portion of the upper body in the foot width direction is larger than a total opening area of the plurality of holes in a side face portion of the upper body in the foot width direction.

6. The upper according to claim 4, wherein
the first low stiffness region includes a plurality of first holes disposed side by side in a front-rear direction and a foot width direction, and
a shape of the plurality of first holes is a rhombus.

7. The upper according to claim 4, wherein
the upper body includes an upper midfoot portion covering a midfoot of the foot, and
the low stiffness region includes a second low stiffness region disposed in the upper midfoot portion.

8. The upper according to claim 7, wherein a point in which the third layer is disposed and a point in which the third layer is not disposed are alternately disposed in the second low stiffness region along a foot width direction.

9. The upper according to claim 7, wherein
the second low stiffness region includes a plurality of second holes disposed side by side in a front-rear direction and in a foot width direction, and
a shape of the second holes is a square or a rectangle.

10. The upper according to claim 1, wherein
the third layer includes a plurality of linear bodies, and
a density of the plurality of linear bodies in the third layer increases from one side to the other side in a front-rear direction.

11. The upper according to claim 1, wherein the upper body is disposed of a single material.

12. A shoe comprising: the upper according to claim 1; and a sole positioned below the upper.

* * * * *